US006044324A

United States Patent [19]

Boerhave et al.

[11] Patent Number: 6,044,324

[45] Date of Patent: Mar. 28, 2000

[54] SYSTEM APPROACH TO STAND-ALONE SOIL SAMPLING

[75] Inventors: Steven J. Boerhave, Cedar Rapids; John F. Cain; Neal P. Feltman, both of Marion, all of Iowa

[73] Assignee: Rockwell Collins, Inc., Cedar Rapids, Iowa

[21] Appl. No.: 08/984,235

[22] Filed: Dec. 3, 1997

[51] Int. Cl.[7] ..... G06F 165/00

[52] U.S. Cl. ..... 702/5

[58] Field of Search ..... 702/2, 3, 5; 706/904, 706/928, 930

[56] References Cited

U.S. PATENT DOCUMENTS 5,220,876 6/1993 Monson et al. ..... 706/904
5,355,815 10/1994 Monson ..... 111/130
5,585,626 12/1996 Beck et al. ..... 250/222.1
5,668,719 9/1997 Bobrov et al. ..... 702/2
5,754,137 5/1998 Durrstein ..... 342/357.17
5,768,128 6/1998 Thompson et al. ..... 702/2

*Primary Examiner*—Donald E. McElheny, Jr.
*Attorney, Agent, or Firm*—Kyle Eppele; James P. O'Shaughnessy

[57] ABSTRACT

A method and apparatus for collecting and analyzing soil chemistry information from a tract of land is described. An information management system receives reference signals from a global positioning system from which soil sample collection coordinate location information may be calculated and utilized to generate a soil sampling plan for the tract of land. The information management system guides the collection of soil samples according to the soil sampling plan and records geo-referenced soil sample collection information which may be merged with the results of laboratory analysis performed on the soil samples to generate accurate geo-referenced soil chemistry information.

20 Claims, 6 Drawing Sheets

SYSTEM APPROACH TO STAND-ALONE SOIL SAMPLING

BACKGROUND OF THE INVENTION

The present invention generally relates to soil sampling methods commonly utilized in agricultural systems and the like, and more particularly to a method and apparatus for collecting and analyzing soil chemistry information from a tract of land utilizing geo-referenced soil sampling.

In modern agricultural systems utilizing precision farming techniques, it is often advantageous to base the application of agricultural products such as seed, fertilizer, lime, and the like on soil chemistry analysis results. Typically, soil chemistry analysis involves the collection of a number of soil samples from a tract of land such as a field or the like. These samples may be analyzed in a soil chemistry laboratory yielding results that may be used by the farmer to generate product application plans.

A common method of soil sampling involves randomly collecting a number of soil samples from a field which are then bulked and mixed thoroughly. A single sub-sample is removed and sent to a soil chemistry laboratory for analysis yielding average soil chemistry results for the entire field. However, this random sample approach has proven to be somewhat limited in its usefulness because it does not indicate areas of high or low yield potential within the field. Consequently, some areas of a field may receive more product than required resulting in waste and unnecessary pollution while other areas may receive less than needed resulting in a reduced yield.

Another method, "Grid Sampling," allows farmers to acquire more accurate information about soil chemistry variation within a field. Two basic methods of grid sampling are known to the art: grid cell sampling and grid point sampling. Grid cell sampling is a process whereby an imaginary grid is laid over a field to determine appropriate locations from which to collect soil samples. Typically, a number of soil samples may be taken randomly from within each grid cell, bulked and mixed. A sub-sample is taken from the bulked samples and sent to a soil chemistry laboratory for testing. Similarly, grid point sampling begins with the generation of a grid to determine locations for collection of soil samples. However, in grid point sampling, soil samples are not taken randomly throughout each grid cell, but instead are collected from within a small radius of each grid intersection. As in grid cell sampling, these samples are bulked, producing a single sample for each grid intersection.

After analysis, a soil chemistry variability map may be generated for the field to aid the farmer in creating a product application plan. Typically, a soil chemistry map displays variations of one or more soil chemistry parameters across the field based on values obtained in each grid cell or at each grid intersection. However, for the soil chemistry map to be accurate, the size of each grid must remain relatively small. Consequently, many soil samples must be collected creating a large amount of data which must be cross-referenced and analyzed. Further, the location from which each soil sample is collected must be accurately calculated and cross-referenced with the results of the laboratory analysis of that soil sample. Thus, it would be advantageous to provide a method and apparatus employing a system approach for collecting and analyzing soil chemistry information from a tract of land utilizing geo-referenced soil sampling.

SUMMARY OF THE INVENTION

Accordingly, a principle object of the present invention is to provide a method and apparatus for collecting and analyzing soil chemistry information from a tract of land utilizing geo-referenced soil sampling.

Another object of the present invention is to provide a method and apparatus for on-site generation of a geo-referenced soil sampling plan for a tract of land.

Still another object of the present invention is to provide an apparatus for guiding an operator to a geo-referenced soil sample collection location utilizing a reference signal from a global positioning system so that the operator may collect a soil sample.

Yet another object of the present invention is to provide a method and apparatus for merging geo-referenced soil sample collection information such as the sample collection location coordinates, in situ soil analysis results, or the like with corresponding soil sample analysis results from a soil chemistry laboratory to yield accurate geo-referenced soil chemistry information for the tract of land.

In accordance with these objectives, the present invention provides a system approach for collecting soil chemistry information from a tract of land utilizing a geo-referenced soil sampling method. An information management system provides on-site generation of a geo-referenced soil sampling plan by determining the boundary or perimeter of the tract of land utilizing a reference signal from a global positioning system and calculating soil sampling coordinate locations within that perimeter. The information management system may also utilize the reference signal to systematically guide an operator to each calculated soil sampling location where a soil sample may be collected. Results of a soil chemistry analysis may be merged with the geo-referenced soil sampling information to yield accurate geo-referenced soil chemistry information for the tract of land.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which:

FIG. 1 depicts a typical soil sampling vehicle having apparatus for collecting and geo-referencing soil samples from a tract of land such as a field or the like;

FIGS. 4A and 4B illustrate a display, according to an exemplary embodiment of the present invention, utilized to guide an operator during the collection of soil samples from a field, wherein FIG. 4A illustrates the display in a map mode and FIG. 4B illustrates the display in a target mode.

DESCRIPTION OF THE PREFERRED EMBODIMENT

Reference will now be made in detail to the presently preferred embodiment of the invention, an example of which is illustrated in the accompanying drawings.

Figure 1:
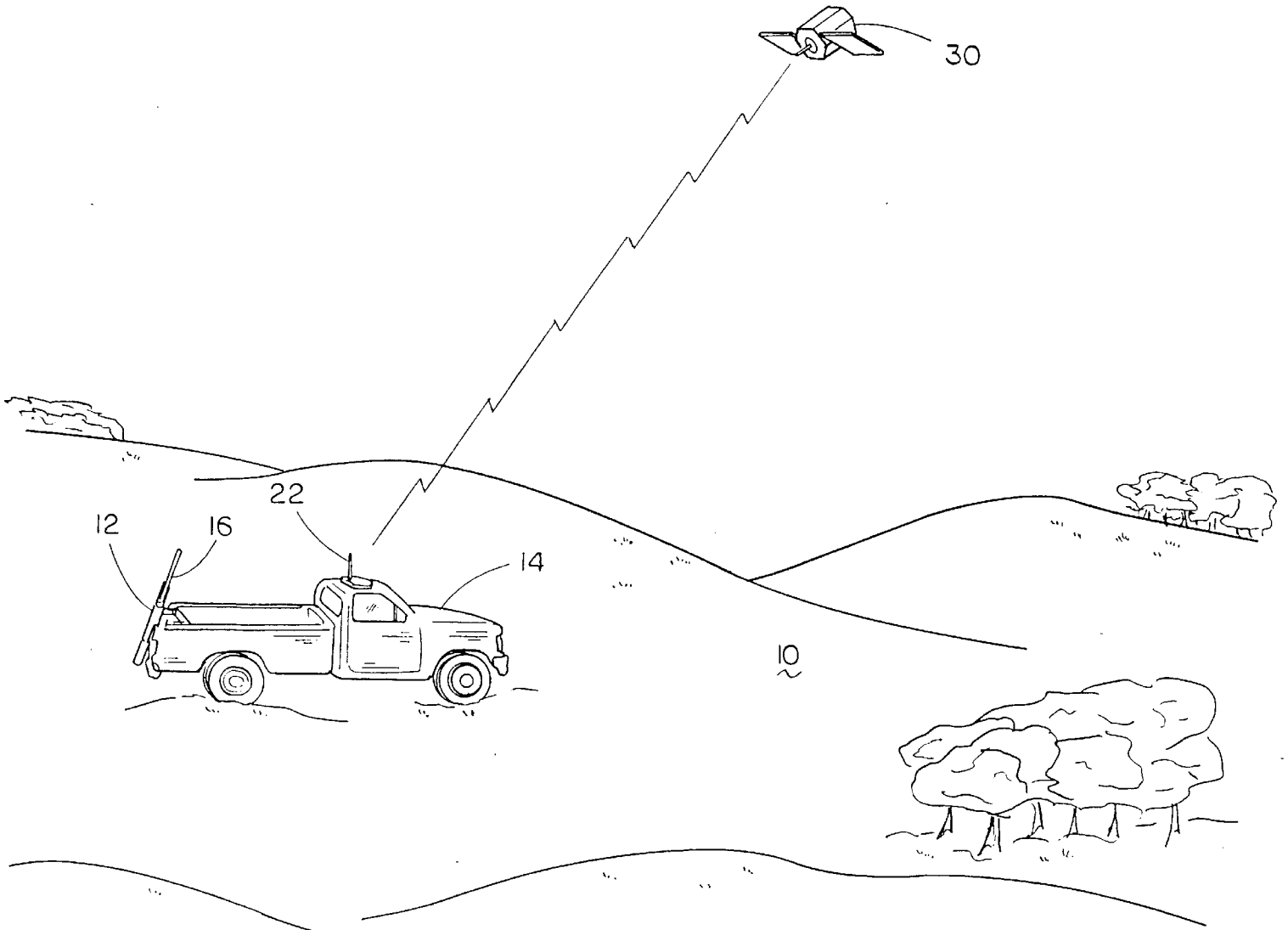

Referring now to FIG. 1, a typical agricultural environment is shown encompassing a tract of land 10 such as a field or the like. The agricultural environment may be a typical farm in which various agricultural products are grown, for example soy beans, wheat, corn, etc. Utilization of scientific or precision farming techniques allows yields of the agricultural products to be maximized. Such scientific farming techniques contemplate accurate management of information concerning events affecting the given tract of land 10 on which the agricultural products are grown. An information management system which utilizes electronic processing of information is preferably utilized to collect, analyze and process farming related information including selected soil chemistry information and the like.

An operator such as a farmer, soil sampling technician, or the like may utilize a soil sampling apparatus 12 to collect soil samples from the tract of land 10. This apparatus 12 may be mounted to a soil sampling vehicle 14, such as a truck, tractor, all purpose vehicle or the like. The soil sampling vehicle 14 is preferably driven by the operator while collecting soil chemistry information, or alternatively may be remotely piloted or controlled by the information management system utilizing a reference signal from a global positioning system.

Preferably, the soil sampling apparatus 12 allows the operator to collect soil samples at various depths beneath the soil's surface utilizing a coring device 16 or the like. Typically, the soil sampling apparatus 12 will be utilized to collect a plurality of soil samples from the top 6 to 12 inches of topsoil using a 1 or 2 inch coring device; however, soil samples taken from deeper levels may at times be desirable and are anticipated by the present invention. Where a dedicated soil sampling apparatus is unavailable, a spade or the like may be employed to collect the samples provided care is taken that each of the samples collected is of a uniform volume with respect to its depth.

Figure 2:
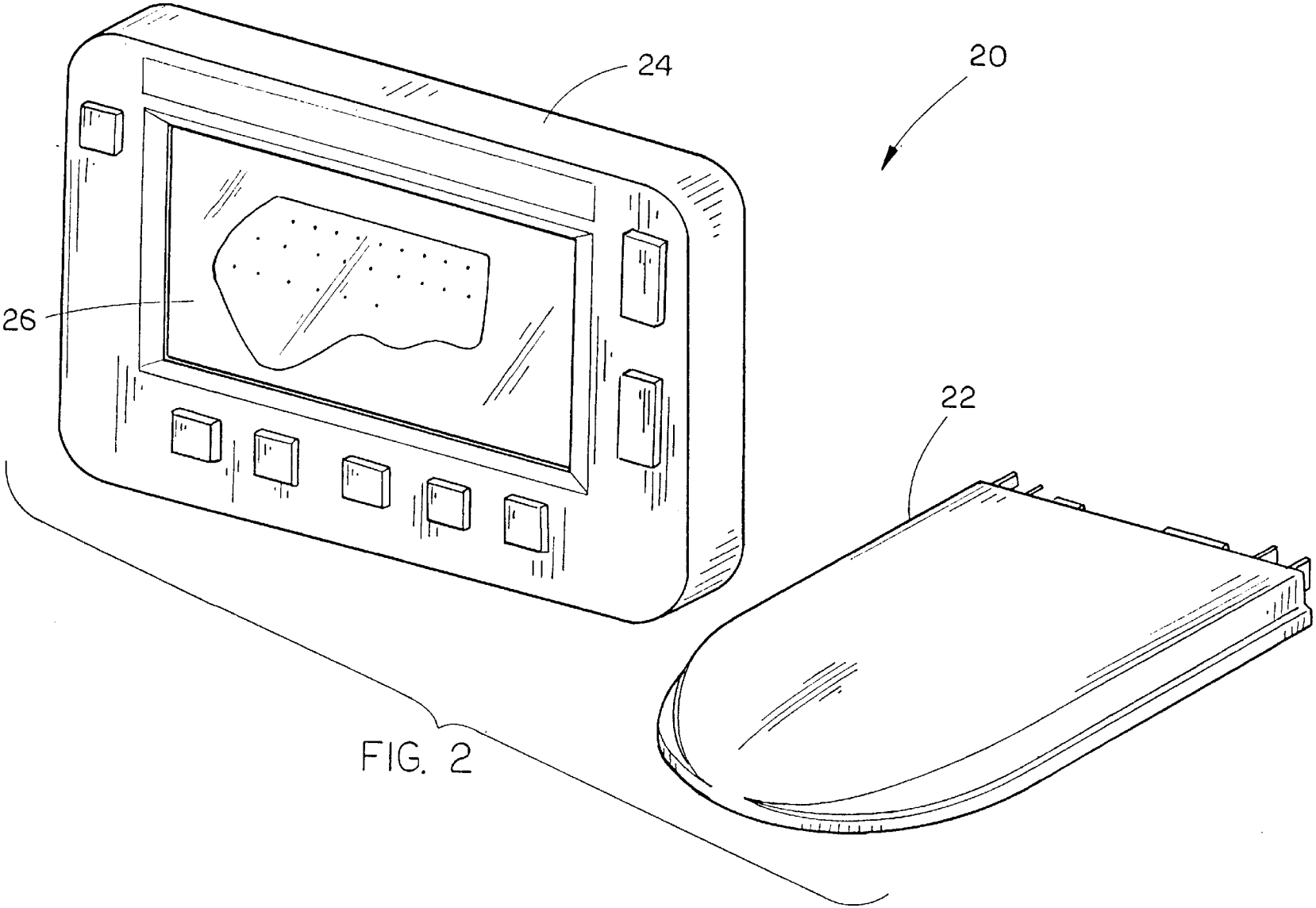
FIG. 2 is a perspective view depicting the fundamental components of an information management system according to an exemplary embodiment of the present invention.

Turning now to FIG. 2, the information management system 20 preferably includes a receiver 22 capable of receiving a geo-referencing signal from a global positioning system in order to accurately georeference the location from which a given soil sample is collected. The global positioning system is preferably the Global Positioning System "GPS"), a space-based radio-navigation system managed by the U.S. Air Force for the Government of the United States. The Government provides civilian access to the Global Positioning System which is called the Standard Positioning Service ("SPS"). The Standard Positioning Service is intentionally designed to provide a positioning capability which is less accurate than the positioning service provided to military operators, however various techniques have been developed to improve the accuracy of the civilian positioning service wherein position accuracy of less than one meter may be achieved.

Returning now to FIG. 1, the information management system may be utilized in conjunction with the Global Positioning System to accurately geo-reference the locations within the tract of land 10 from which soil samples are collected. The information management system 20 (FIG. 2) is preferably easily installed in and removed from the soil sampling vehicle 14. A receiver 22 having an integral antenna receives the reference signal from a satellite 30 operating as part of the GPS satellite constellation. Typically the signals from at least three satellites are required to derive a coordinate position solution. Further reference signals which are not part of the government operated GPS system may also be used in order to compensate for the degraded civilian GPS signal (which may be transmitted as an FM carrier sublink by land based or space based locations or by an RS-232 data bus, for example). Such correcting signals may be provided by a third-party differential correction service provider. Other ways of correcting the degraded civilian signal may also be utilized which do not require an independent correcting signal to be transmitted. For example, signal processing techniques such as cross correlation of the military signal and the civilian signal may be utilized to improve the accuracy of the civilian signal.

Referring again to FIG. 2, components of the information management system 20 of the present invention are shown. The information management system 20 fundamentally comprises a receiver 22 and a computer processing system 24. The receiver 22 is preferably utilized to receive GPS signals to be converted into signals capable of being processed by the computer processing system 24. The computer processing system 24 further includes a user interface 26 such as a display or the like for user input and control and for information display. The computer processing system 24 may interface with a soil sampling apparatus 12 (FIG. 1) which may automatically collect and/or analyze soil samples from the field.

A system approach for collection, analysis and utilization of soil chemistry information from the tract of land may involve several steps which may be integrated together by the information management system taking into account variables encountered at each preceding step. As shown in FIG. 3, the information management system may employ a grid sampling method to collect and geo-reference a plurality of soil samples from a tract of land 10. The information management system preferably divides the tract of land into a plurality of regularly shaped sampling areas or grids 40. These grids may be square, rectangular, diamond shaped, or the like. Grid size is preferably site specific and may be varied by the operator based on factors such as the soil features of the particular tract of land, cost, field size, or the like. For example, the spacial variation of soil chemistry information may depend on the parameter being measured. Often it may be necessary to collect soil samples utilizing a fine grid to initially define the spatial variability. Subsequent measurements may then be made at a scale providing the required information without excessive sample collection.

In an exemplary embodiment, operator provided information such as grid size, shape and orientation may be provided to the computer processing system via the operator interface. The operator interface preferably allows the computer processing system to prompt the operator for all information required to calculate a grid based soil sampling plan. For example, the operator may be prompted to provide the desired X-axis grid length and Y-axis grid length allowing the information system to calculate the desired grid size. The operator may also be prompted to provide a geo-referenced starting point 42 for collecting grid samples and an initial direction of travel 44. Alternatively, the computer processing system may be instructed to determine these parameters based on the current position and orientation of the soil sampling vehicle utilizing the reference signal received from the global positioning system via the receiver.

The present system may also utilize a directed sampling plan wherein calculation of soil sample collection locations may be based on some prior knowledge of the field 10. The information management system may generate a soil sampling plan based on spatial patterns defined by information such as the field management history, prior soil chemistry information, yield results, or the like instead of the spacial grid (illustrated in FIG. 3A). Thus, the field may be divided into soil units of varying size which may be classified as being homogeneous. Each of these units may then be sampled independently in a manner similar to the grid sampling scheme described herein according to a preferred embodiment of the present invention.

The information management system may automatically correct for a difference in the mounting positions of the antenna of the GPS receiver 22 and the soil sampling apparatus 12. This correction may be done by prompting the operator for the X-axis antenna offset and Y-axis antenna offset.

It should now be obvious that a Z coordinate axis may be utilized by the system to allow a third dimension to be considered. Thus, the system could be adapted to collect soil samples from various depths beneath the surface, include information about the land's topography and altitude, or the like.

Figure 3A:
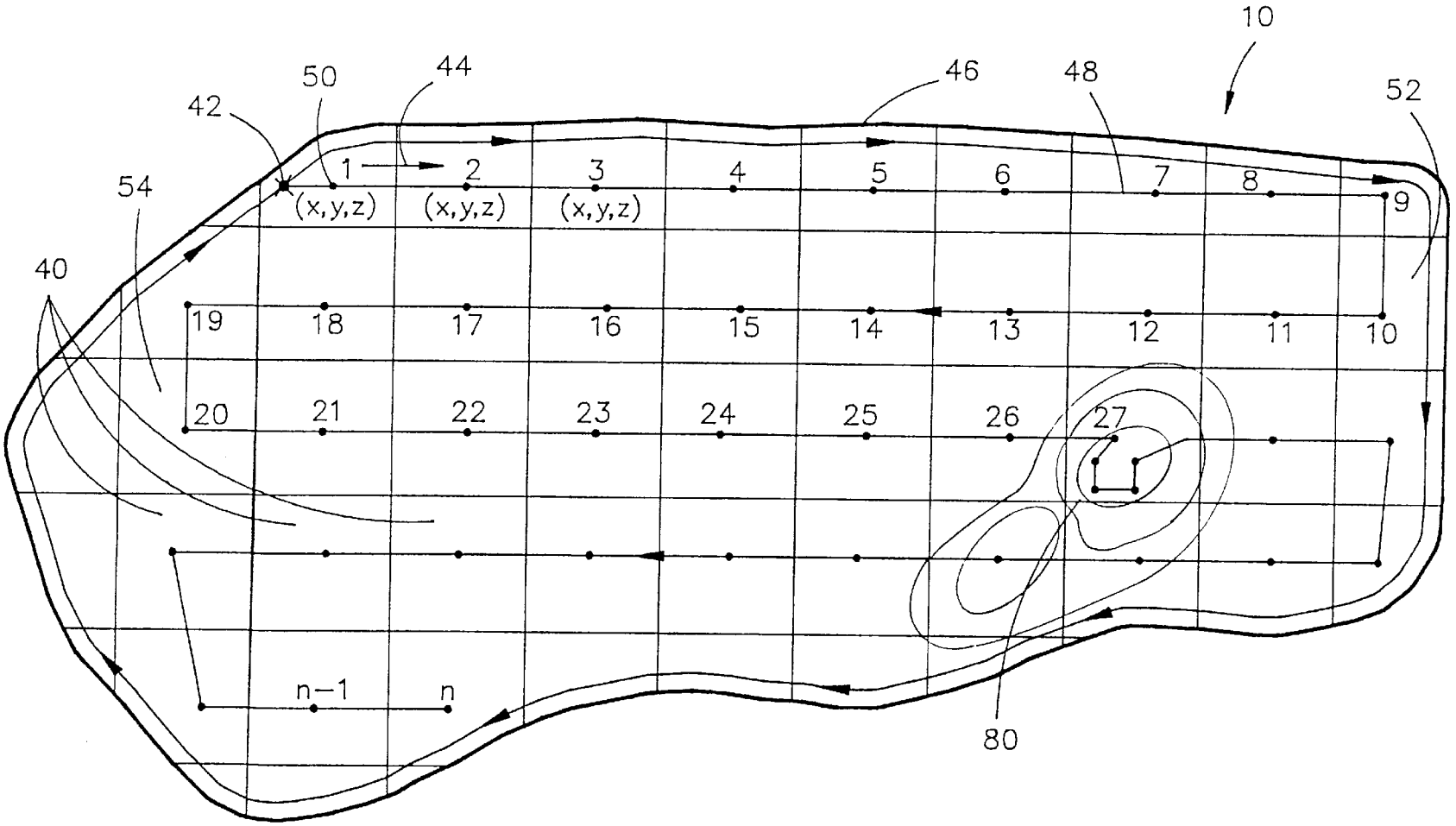
FIGS. 3A and 3B depicts an exemplary soil sampling plan which may be generated by the information management system, wherein a field may be divided into a plurality of grids and wherein a serpentine pattern may be followed to systematically collect the soil samples from each grid.

The information management system may calculate the path from which the operator is to collect soil samples. Preferably, the information management system facilitates the collection of soil samples from a tract of land wherein the boundaries of the tract are unknown at the start of soil sample collection and wherein no predetermined soil sampling plan or work order exists. Typically, an agricultural tract of land such as a field may be bounded by roads, streams, forests, or the like causing it to have an irregular shape. As shown in FIG. 3A, the information management system may determine and geo-reference the boundaries or perimeter 46 of the tract of land 10 from which soil samples are to be collected utilizing the geo-referencing signal received from the global positioning system. The information management system may then calculate coordinate positions for each soil sample collection location such that they lie within the field boundary or perimeter 46.

FIG. 3A illustrates a method for determining the boundary or perimeter of the tract of land. The soil sampling vehicle having mounted thereto the global positioning system receiver may be driven about the perimeter 46 of the field 10 by the operator. Geo-referenced coordinate positions along the field perimeter 46 may be periodically sampled by the computer processing system via the receiver and electronically recorded to a database or the like. These coordinate positions may be further processed at a later date in an office environment, for example. Preferably, the geo-referenced perimeter coordinate positions, when interconnected, allow the information management system to generate an outline or map corresponding to perimeter of the field.

Many agricultural fields are bounded by fences, roads, ditches or the like. Thus, a soil sampling vehicle such as a truck, tractor or APV may be prevented from following the true perimeter of the field. The information management system may provide automatic correction of this limitation by allowing the vehicle to be driven at a fixed distance or offset from the fence or other obstacle. The computer processing system may then utilize this offset, which may be entered therein by the operator, to adjust the recorded perimeter coordinate positions accordingly. Preferably, the information management system automatically ties together the last location recorded along the field perimeter with the first location recorded to complete the field boundary.

The information management system may generate a soil sampling plan utilizing information provided by the operator. The soil sampling plan may be displayed to the operator via the operator interface allowing the operator to make adjustments thereto to compensate for peculiar field conditions or the like. For example the operator may define a reference point to which the soil sampling grid may be referenced. Additionally, the operator may adjust the grid size and grid angle to define size and tilt of the grid and alter the route the operator will take to collect the soil samples.

After the operator makes necessary adjustments to the soil sampling plan for peculiar field conditions, the information management system preferably identifies the coordinate position from which each soil sample is to be taken and records this information in a database or the like. As shown in FIG. 3A, the soil sampling plan may employ a collection and labeling scheme wherein soil samples are collected from the field in a serpentine pattern 48. Utilizing the starting point 42 and initial direction of travel 44 provided by the operator as references, the computer processing system may sequentially label the soil sample collection locations, for example 1 through n having corresponding geo-referenced coordinate locations $(x_1,y_1,z_1)$ through $(X_n,Y_n,Z_n)$, wherein the x and y coordinates may represent latitude and longitude, respectively, and the z coordinate may represent altitude, depth, or the like. A first collection location 50, numbered 1, may be defined in the center of the grid 52 closest to the starting point 42. Subsequent soil sample collection locations may be identified at the center of each adjacent grid lying along an imaginary line defined by the initial direction of travel 44 until the information management system determines that the next collection location would lie beyond the previously determined field boundary 46. Preferably, the system then identifies the next soil sample collection location as the center of the grid 52 that the soil sampling vehicle would enter after making a turn to the right or left as defined by the soil sampling plan. From this grid cell, subsequent samples may be identified at the center of each adjacent grid lying along a line parallel to and opposite of the initial direction of travel 44 entered by the operator. When the field boundary 46 is again encountered, the system preferably identifies the next sample location as being in the center of the grid 52 that the vehicle would enter after making a second turn directly opposite of the first turn. From this grid cell, subsequent samples may be identified at the center of each adjacent grid lying along a line parallel to and in the same direction of the initial direction of travel 44 entered by the operator. This serpentine pattern 48 may be repeated until all grids 40 within the field boundary 46 have a soil sample collection location identified and geo-referenced.

Upon identification of all soil sample collection locations, the operator may begin collecting soil samples from the field according to the soil sampling plan. To aid the operator, the information management system may indicate the soil sampling vehicle's position relative to a selected sample collection location based on the geo-referencing signal received from the global positioning system. Once the operator navigates to and collects a soil sample from a soil sample collection location, the information management system may automatically determine and display navigation information necessary to guide the operator to the next soil sample collection location. Preferably, the navigation information may be updated periodically by the computer processing system based on the reference signal received from the global positioning system via the receiver as the soil sampling vehicle moves from location to location.

As shown in FIG. 2, the computer processing system 20 may include an operator interface 26 such as a display or the like. This interface 26 may be operable in one or more operator selectable display modes to direct the operator to each soil sample collection location of the soil sampling plan as identified by the information management system. The operator interface 26 may further allow the operator to access the database to retrieve information recorded at each soil sample collection location.

Figure 4A:
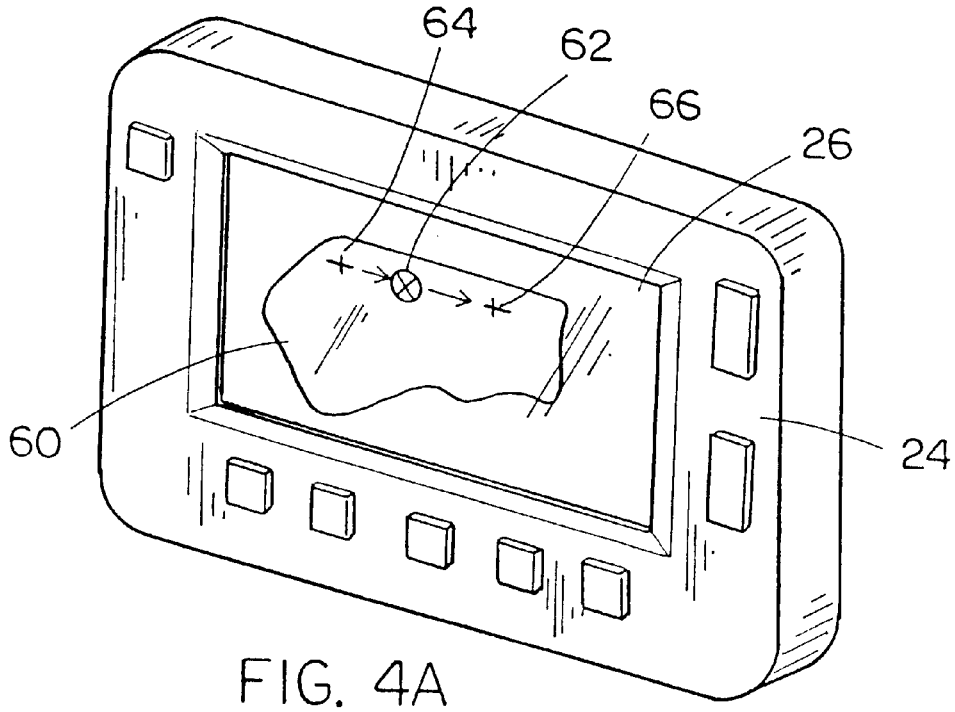

Turning now to FIG. 4A, the operator interface may be operable in a map mode wherein the computer processing system 24 may display a field map 60 providing a graphic illustration of the boundary or perimeter of the field, or, alternatively, an operator selectable portion thereof. Preferably, the field map 60 may be generated by the computer processing system 24 utilizing the geo-referenced field boundary information. While in map mode, the computer processing system 24 may graphically represent various operator selected information layers of the database such as the system generated sampling grid, identified soil sample collection locations, or the like as overlays to the field map. In an exemplary embodiment, the map mode may indicate the position of the soil sampling vehicle 62 as it moves between collection points 64 and 66 and may include a zoom feature to allow the area immediately around the soil sampling vehicle to be viewed in detail by the operator.

Figure 4B:
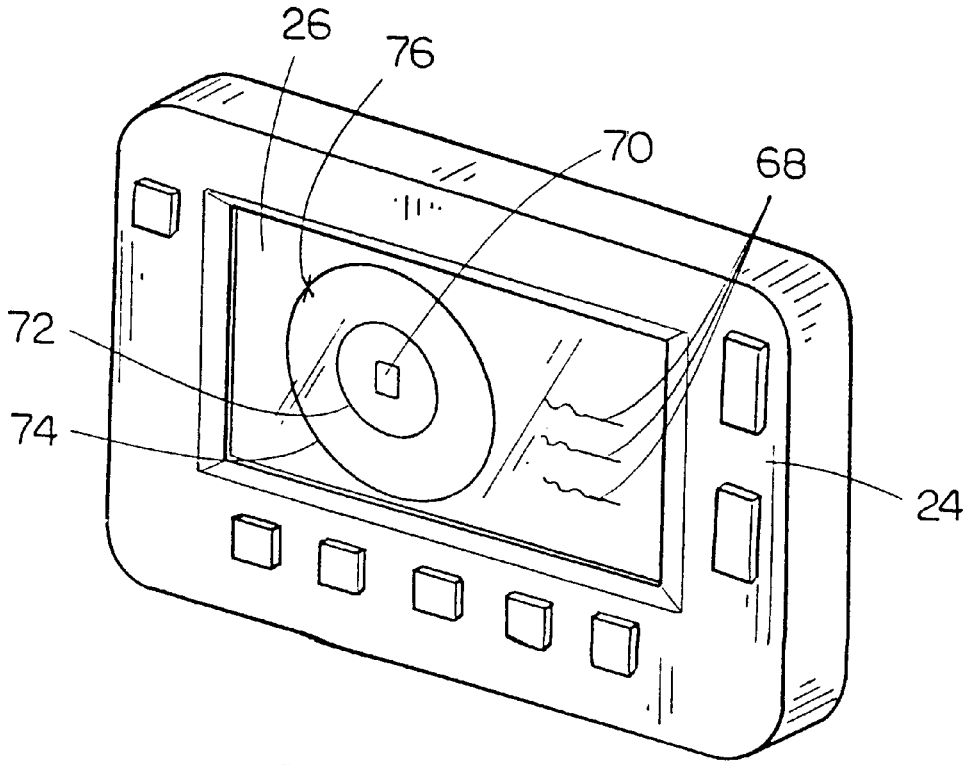

FIG. 4B illustrates a second mode of display, hereinafter termed the target mode, wherein the computer processing system 24 may display the position of a selected soil sample collection location relative to the soil sampling vehicle's position. Preferably, the system calculates and displays the bearing and distance 68 from the soil sample collection vehicle to the soil sample collection location. In an exemplary embodiment, the display when placed in target mode may include a graphical representation of this information which may include an overhead plan or "bird's-eye" view depicting the relative position of the soil sample collection location with respect to the soil sampling vehicle's position. The vehicle may be depicted by a graphic representation 70 thereof which may be fixed at the center of the display 26. Auto adjustable concentric rings 72 and 74 may encircle the vehicle graphic 70 and may indicate the bearing and distance to the selected soil sample collection location 76. The system may indicate movement of the vehicle by changing the displayed position of the soil sample collection location graphic 76 with respect to the fixed vehicle graphic 70 and the concentric rings 72 and 74. For example, when the soil sampling vehicle approaches a soil sample collection location, the computer processing system may, utilizing the reference signal received from the global positioning system, reduce by a corresponding amount the distance between the displayed position of the soil sample collection location graphic 76 and the fixed soil sampling vehicle graphic 74. In this manner, the information management system may guide the operator to each identified soil sample collection location utilizing the reference signal received from the global positioning system.

Figure 3B:
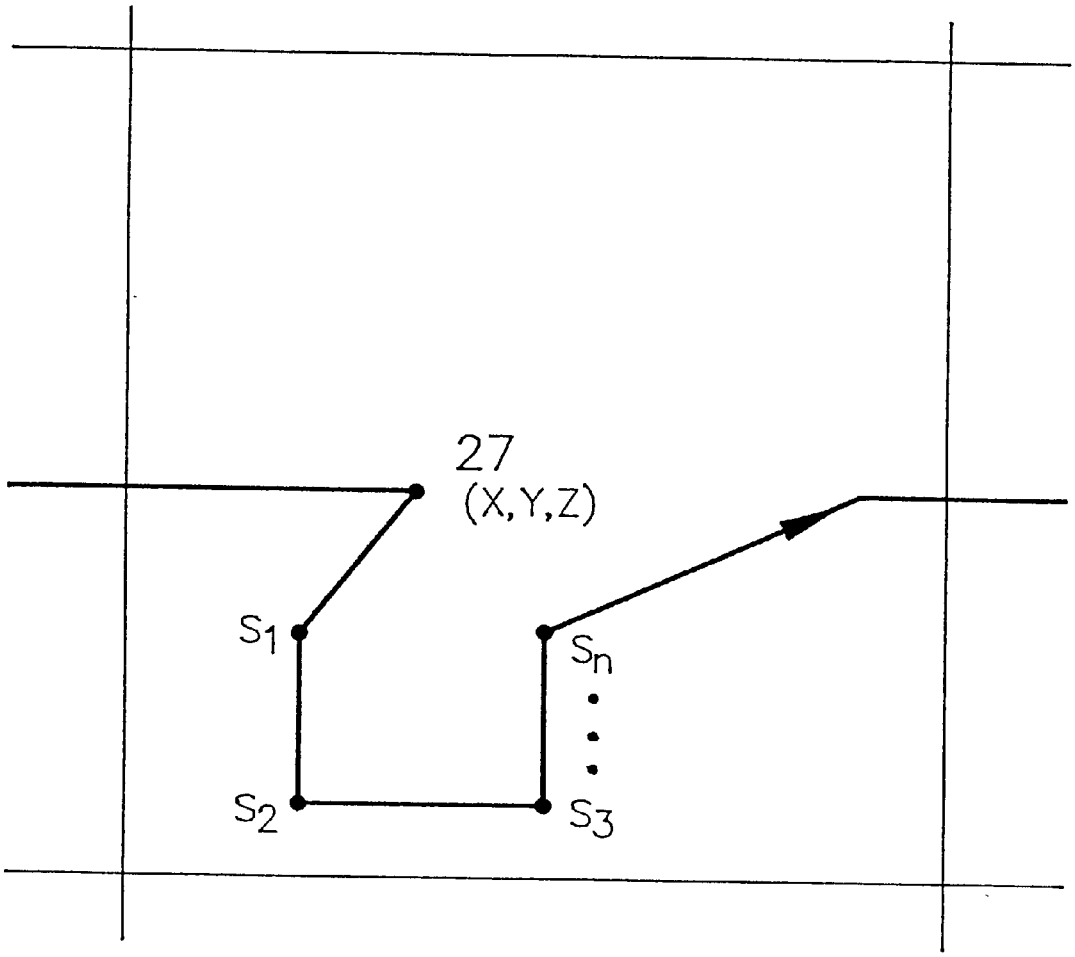

Returning now to FIG. 3A, the tract of land may include areas 80 which have unusual soil features or which in the past have experienced unusually low crop yields. The present system allows additional or unplanned soil samples to be collected from such areas 80 and integrated into the database. Preferably, the operator may collect the unplanned soil samples either during or after soil samples are collected from the identified soil sample locations. As shown in FIG. 3B, the operator may navigate the soil sampling vehicle to the position within the field from which unplanned soil sample is to be collected and collect the sample (identified as $S_1$, $S_2$ through $S_n$, in FIG. 3). The information management system may then append information corresponding to the unplanned soil sample to the database. This information may include, for example, a coordinate position for the unplanned soil sample collection location based on the reference signal received from the global positioning system.

Similarly, the operator may often be unable to navigate to the exact coordinate position of the identified soil sample collection location calculated by the system due to field topography or the like. To account for this limitation, the information management system may allow the operator to update the calculated soil sample location with the actual soil sample collection location based on the geo-referenced signal received from the global positioning system by the receiver, should the operator determine that the actual location varies to greatly from the calculated location. Alternatively, the system may automatically update the calculated soil sample collection location with the actual collection location should those locations differ beyond a predetermined tolerance.

Soil samples collected from a field are typically returned to a soil chemistry laboratory or the like for analysis. Each sample must therefore be labeled to allow laboratory analysis results to be cross-referenced with the geo-referenced soil sample collection information Preferably, apparatus operably connected to the information management system may automatically label each soil sample collected from the field. For example, each soil sample container may be provided with a bar coded label which may have encoded thereon all geo-referenced soil sample collection information necessary to identify the sample. This example keeps the geo-referenced information with the soil sample container. Another approach allows the operator to keep separate to geographic location from the test results, thus allowing the user to merge the information instead of the lab. With the latter approach, apparatus operably connected to the Information Management System may automatically read the soil sample container's label and store this information into a geo-referenced database collected by the Information Management System. In both cases, the soil samples are sent to the laboratory for analysis. Soil chemistry laboratory personnel may then analyze the soil samples and record the analysis results. Typically, a soil chemistry laboratory may be capable of analyzing a wide variety of soil chemistry parameters from each soil sample. These parameters may include soil pH level, lime content, soil nitrate-N content, soil sulfate-S content, macronutrient content (including phosphorus, potassium, calcium, and magnesium), micronutrient content (including manganese, zinc, copper, and boron), soil organic matter, soil cation exchange capacity, soluble salts content, and the like.

Figure 5:
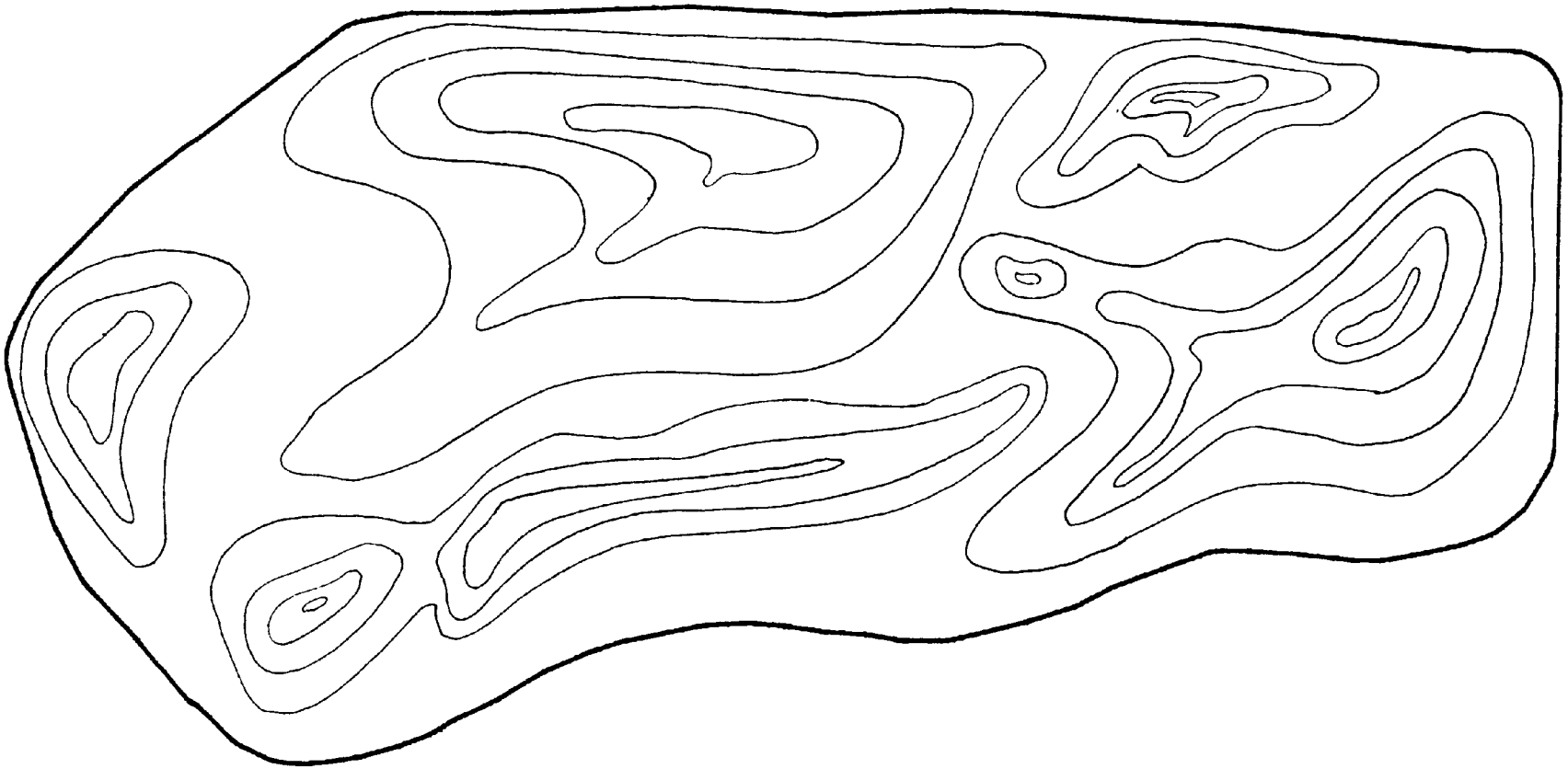
FIG. 5 depicts an exemplary soil chemistry variability map which may be generated for the tract of land according the method utilized by present invention.

Laboratory soil chemistry analysis results may be recorded in a multi-dimensional soil chemistry analysis results database. The soil chemistry analysis results database may be merged with the geo-referenced soil sample collection information stored in a separate database yielding geo-referenced soil chemistry information which may be used, for example, to generate a soil chemistry variability map (FIG. 5). A farmer or agronomist may then utilize the soil chemistry variability map to prepare a product application plan for the field allowing selective application of agricultural products such as seed, fertilizer, lime and the like via variable rate application equipment, for example. Actual product application information may be recorded by the information management system during product application and merged into the database. Upon harvesting of the crop from the field, geo-referenced yield information may be collected. This yield information may likewise be merged into the database. In an exemplary embodiment, the database, now including geo-referenced product application and crop yield information, may be utilized to generate a directed soil sampling plan or the like for collecting additional soil chemistry information, for example, during the next planting season.

Most soil chemistry parameters such as soil pH, organic matter content and the like remain relatively stable over long periods of time, and, therefore may lend themselves to infrequent laboratory analysis. However, certain other parameters such as soil nitrate content and soil moisture content may vary greatly in only a short period of time making conventional laboratory analysis unfeasible or inaccurate. Consequently, accurate measurement of such temporally sensitive parameters must be made utilizing apparatus capable of in situ soil sample analysis. Additionally, in situ analysis of soil chemistry parameters may at times be faster and more efficient than conventional laboratory analysis.

The information management system of the present invention anticipates utilization of in situ soil sample analysis apparatus to collect soil chemistry information from a tract of land. The soil sampling apparatus 12 shown in FIG. 1 may comprise an in situ soil chemistry sensing apparatus capable of electronic real-time sensing of various soil chemistry parameters. The computer processing system may receive soil chemistry information collected by the in situ soil chemistry sensing apparatus. This soil chemistry information may be geo-referenced to the coordinate soil sample collection location and recorded as layers of the database. In addition to in situ analysis, the soil sampling apparatus of this embodiment may collect and label soil samples for further analysis in a conventional soil chemistry laboratory. Results of the laboratory analysis may be merged with the database to provide additional layers of information to the farmer, agronomist, or the like.

It is believed that the system approach to collection and analysis of soil chemistry information of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method for collecting soil chemistry information from a tract of land comprising:

receiving a reference signal from a global positioning system;

defining a perimeter of the tract of land based upon the received reference signal;

generating a sampling plan by calculating a plurality of coordinate positions within the perimeter from which soil chemistry information is to be collected;

locating a coordinate position of the sampling plan using a received reference signal from the global positioning system; and collecting soil chemistry information from the coordinate position.

2. A method according to claim 1, further comprising the step of logging the coordinate position from which the soil chemistry information is collected.

3. A method according to claim 2, wherein the step of collecting soil chemistry information comprises taking a soil sample for analysis in a soil chemistry laboratory.

4. A method according to claim 3, further comprising the step of analyzing the soil sample and yielding soil chemistry analysis results.

5. A method according to claim 4, wherein said analyzing step includes recording the results of the soil sample analysis in a database.

6. A method according to claim 4, further comprising the step of merging the soil chemistry analysis results with the coordinate position from which the soil sample was collected whereby the soil chemistry analysis results are geo-referenced.

7. A method according to claim 1, wherein the step of collecting soil chemistry information comprises in situ analysis of a soil sample.

8. A method according to claim 7, further comprising the step of logging the soil chemistry information to a database.

9. A method according to claim 1, further comprising the step of creating a soil chemistry variability map utilizing the collected soil chemistry information.

10. A method for collecting soil chemistry information from a tract of land utilizing geo-referenced soil sampling, said method comprising:

receiving a reference signal from a global positioning system;

defining a perimeter of the tract of land based upon the received reference signal;

generating a sampling plan by calculating a plurality of coordinate positions within the perimeter from which a soil sample is to be collected;

locating a coordinate position of the sampling plan using a received reference signal from the global positioning system;

collecting a soil sample from the calculated coordinate position;

logging the coordinate position from which the soil sample is collected;

analyzing the soil sample and yielding soil sample analysis results; and merging the soil sample analysis results with the coordinate position from which the soil sample was collected.

11. A method according to claim 10, wherein said collecting step includes placing the soil sample in a storage container.

12. A method according to claim 11, wherein said logging step includes recording said coordinate position on the storage container via a bar code.

13. A method according to claim 10, wherein said analyzing step includes recording the results of the soil sample analysis in a database.

14. A method according to claim 10, wherein said merging step includes creating a soil chemistry variability map.

15. A method according to claimed 10, further comprising the step generating a agricultural product application plan based on the soil chemistry variability map.

16. An information management system for collecting soil chemistry information from a tract of land utilizing geo-referenced soil sampling comprising:

a receiver suitable for receiving a reference signal from a global positioning system;

a computer processing system operatively connected to said receiver for generating a sampling plan by calculating a plurality of coordinate positions within a defined perimeter of a tract of land from which soil samples are to be collected and determining the coordinate location from which each of said soil samples is collected based upon the global positioning system reference signal; and an operator interface suitable for providing navigation and soil sample collection information calculated by said computer processing system utilizing said reference signal to an operator for navigating to and collecting soil samples from said plurality of coordinate positions of said sampling plan.

17. The information management system of claim 16, wherein said operator interface comprises a display.

18. The information management system of claim 16, wherein said receiver is a GPS receiver.

19. A method according to claim 1, wherein said locating step comprises navigating to each of the calculated coordinate positions utilizing a reference signal from the global positioning system.

20. A method according to claim 10, wherein said locating step comprises navigating to each of the calculated coordinate positions utilizing a reference signal from the global positioning system.

* * * * *